US006740021B2

(12) United States Patent
Evans et al.

(10) Patent No.: US 6,740,021 B2
(45) Date of Patent: May 25, 2004

(54) DEVICE AND METHOD FOR LONGITUDINALLY FOLDING A STACK OF WEBS

(75) Inventors: John H. Evans, Neenah, WI (US); Adam Glass, Appleton, WI (US); Leslie T. Long, Appleton, WI (US); Ronald R. Padak, Suwanee, GA (US); Ricky W. Purcell, Alpharetta, GA (US)

(73) Assignee: Kimberly Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/035,102

(22) Filed: Dec. 28, 2001

(65) Prior Publication Data

US 2003/0125179 A1 Jul. 3, 2003

(51) Int. Cl.[7] ..... B31B 1/26
(52) U.S. Cl. ..... 493/405; 493/446; 493/447
(58) Field of Search ..... 270/39.01, 40; 493/405, 455, 456, 446, 447, 443

(56) References Cited

U.S. PATENT DOCUMENTS

| | | | | |
|---|---|---|---|---|
| 3,066,932 A | | 12/1962 | Greiner et al. | |
| 3,122,361 A | | 2/1964 | Moore | |
| 3,307,844 A | | 3/1967 | Stults | |
| 3,401,927 A | | 9/1968 | Frick et al. | |
| 3,401,928 A | | 9/1968 | Frick | |
| 3,462,043 A | | 8/1969 | Frick | |
| 3,519,263 A | | 7/1970 | Frick et al. | |
| 3,542,356 A | * | 11/1970 | Murphy et al. | 270/40 |
| 3,679,094 A | | 7/1972 | Nissen et al. | |
| 3,679,095 A | | 7/1972 | Nissen et al. | |
| 3,707,281 A | | 12/1972 | Murphy et al. | |
| 3,817,514 A | | 6/1974 | Nissen et al. | |
| 3,834,689 A | | 9/1974 | Lee et al. | |
| 3,841,620 A | * | 10/1974 | Lee et al. | 270/40 |
| 3,870,292 A | | 3/1975 | Bradley | |
| 4,052,048 A | * | 10/1977 | Shirasaka | 270/40 |
| 4,131,271 A | | 12/1978 | Slawny | |
| 4,190,241 A | | 2/1980 | Krueger | |
| 4,285,686 A | * | 8/1981 | Ambler | 493/439 |
| 4,304,561 A | * | 12/1981 | Shingo | 493/439 |
| 4,502,675 A | * | 3/1985 | Clark et al. | 270/40 |
| 5,788,226 A | | 8/1998 | Peglow | |
| 5,868,276 A | | 2/1999 | Loppnow et al. | |
| 5,902,222 A | | 5/1999 | Wessman | |
| 5,992,682 A | | 11/1999 | Loppnow et al. | |
| 6,045,002 A | | 4/2000 | Wierschke | |
| 6,238,328 B1 | | 5/2001 | Loppnow et al. | |

FOREIGN PATENT DOCUMENTS

| | | |
|---|---|---|
| GB | 1110723 | 4/1968 |

* cited by examiner

*Primary Examiner*—Eugene Kim
(74) *Attorney, Agent, or Firm*—Douglas H. Tulley; Sue C. Watson

(57) ABSTRACT

Folding apparatus and systems are described for providing multi-folded products utilizing a folding board having at least one pressurized nip positioned proximate the folding operation. A folded product is directed through a first pressurized nip, comprising a roller and a first surface of a second folding board, positioned upstream of the folding operation and a second pressurized nip, comprising a roller and a second surface of the folding board, positioned downstream of the folding operation. Positioning pressurized nips proximate the folding operation improves the integrity of the folds created within the product and also creates distinct, uniformly oriented fold lines.

11 Claims, 10 Drawing Sheets

DEVICE AND METHOD FOR LONGITUDINALLY FOLDING A STACK OF WEBS

BACKGROUND

Folding devices, such as boards or plates, have long been used to longitudinally fold webs and other sheet-like materials in order to form a stack of folded sheets. The sheets are, generally speaking, drawn over the folding device wherein the shape and configuration of the device causes the sheet to twist and bend thereby producing the desired fold. Folding devices have heretofore been provided in a variety of shapes and configurations in order to achieve the desired fold lines and folding patterns. Folding devices have been used to form a number of different folds including, for example, half-folds, quarter folds, c-folds, v-folds, j-folds, w-folds, z-folds, and so forth.

In addition, for more complex folds requiring multiple fold lines, it is known to form the necessary fold lines using two or more folding devices in series. In this regard, folding boards have also been used in series to achieve inter-folded or inter-leafed sheets, that is to say sheets folded such that they partially envelope portions of another sheet. Inter-leafed sheets are commonly employed in stacks as a mechanism to facilitate removal of the individual sheets from a dispenser. Withdrawal of a first sheet through a dispenser opening pulls the enveloped potion of a second sheet through the dispenser opening such that it extends out of the dispenser opening and is exposed. Having a portion of the subsequent sheet extending out of the dispenser opening greatly facilitates removal of the same from the dispenser by the user. By way of example only, various folding devices, folding patterns and inter-folding schemes are described in the following U.S. Pat. Nos. 3,401,928; 3,679,094; 3,817,514; 3,841,620; 4,131,271; 4,502,675; 5,868,276; 6,045,002; and 6,168,848.

These folding devices are often advantageous since they allow folding of rolls of sheet material and, typically, allow for increased converting speed relative to many mechanized or rotary folding machines. However, due to the manner in which the sheets are folded, stress and friction associated with drawing the continuous sheet material across and/or through the folding devices can cause various aesthetic and physical defects within the sheet material. As an example, the twisting and pulling forces can alter the dimensions of the sheet material. In addition, these and other physical forces can also create undesirable wrinkles or creases in the sheet material. In this regard it is believed that the stress resulting from the twisting forces and friction cause the sheet material to "buckle" or wrinkle in order to decrease the physical forces upon the sheet. Further, when using multiple folding devices in a series, these same forces can act to degrade previously formed fold lines and/or to cause prior folds to "roll" thereby changing the location of the fold within the sheet material. This can, undesirably, cause the formation of a fold line with an irregular orientation, i.e. a fold line that does not have uniform direction and/or placement. Still further, these forces can also cause the formation of a double fold line, i.e. a "shadow" fold. These and like irregularities are defects that are aesthetically displeasing to the end user. Further, defects such as irregular fold lines and other fold defects can also create problems with packaging and/or dispensing of the product. For example, stacks of folded sheets are commonly packaged in a clip and variation in stack height, such as due to variations in sheet folds, can make packaging difficult or ultimately destroy the packaging clip, such as where a paper sleeve is used.

Thus, there exists a need for folding devices capable of longitudinally folding webs and sheet materials that avoid the formation of defects such as wrinkles and unwanted creases. Further, there exists a need for such a device that produces uniform fold lines and prevents the formation of irregularly oriented fold lines. Still further, there exists a need for a folding device that avoids the formation of double folds along an intended fold line. Still further, there exists a need for a folding device that generates accurate and stable dimensions within the resulting folded product and stack.

SUMMARY OF THE INVENTION

Figure 1:
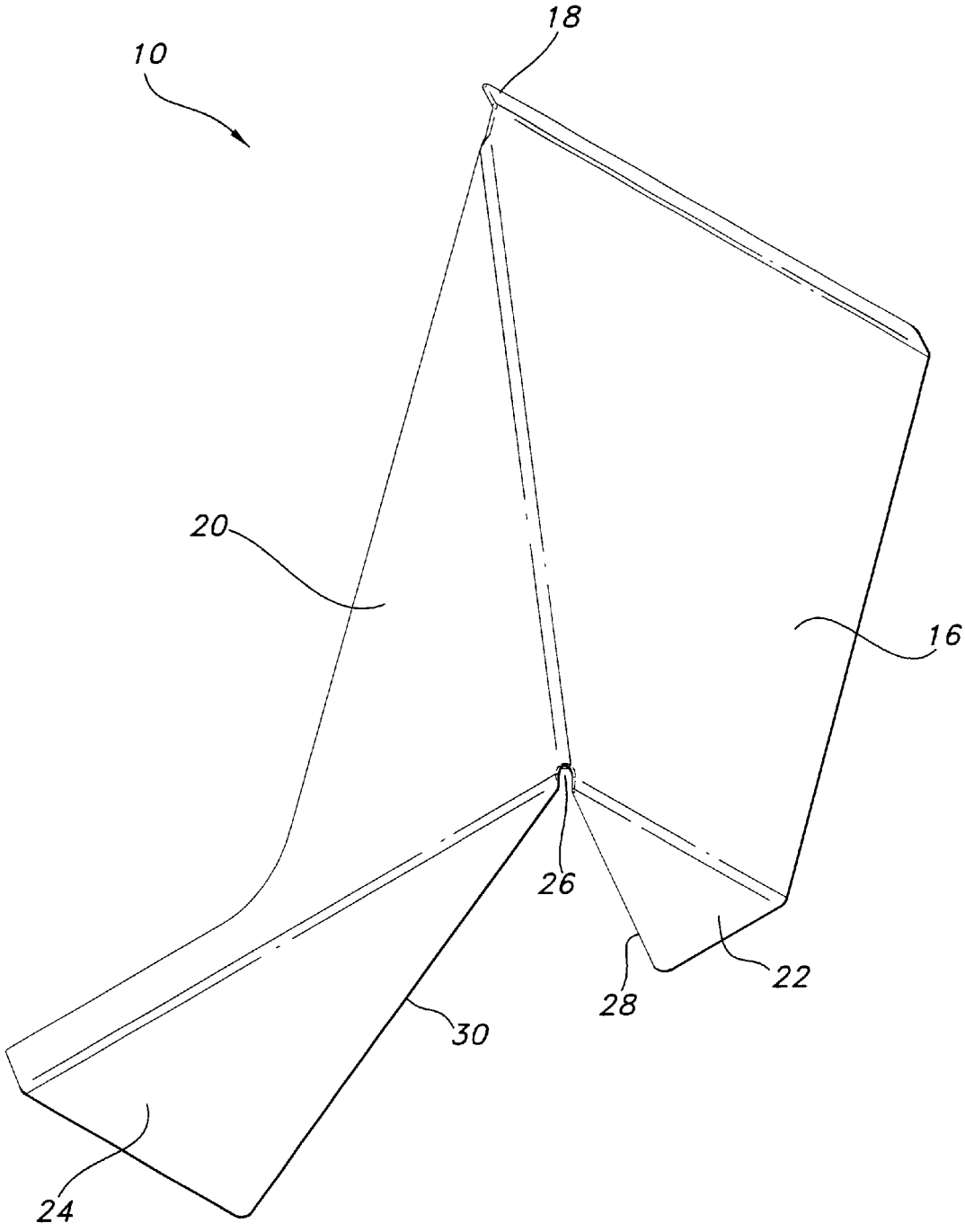
FIG. 1 is an angled, rearview of the underside a folding board.

The aforesaid needs are fulfilled and the problems experienced in the prior art overcome by the folding device and methods of the present invention. In accordance with one embodiment of the present invention a device for folding a sheet material is provided having a plurality of surfaces and adapted to longitudinally fold a sheet material drawn across said folding device. The folding device further comprises a first surface, a second surface and a first creasing mechanism. The first surface extends in a first plane and, in an additional embodiment, the first creasing mechanism forms a pressurized nip with the first surface. In an another embodiment, the folding device can comprise a second creasing mechanism. The second surface desirably extends in a second plane and, in one embodiment, the second creasing mechanism can form a pressurized nip with the second surface. The second surface can be adjacent the first surface and is not parallel with the first plane wherein the sheet material is caused to bend or fold as it travels across the surfaces of the folding device. In a further embodiment, the first and/or second creasing mechanisms may comprise a roller. Further, the first and/or second creasing mechanisms may be positioned within about 1 meter of the folding operation. Still further, the folding device can also include a mechanism for altering the nip pressure.

In an alternate embodiment a system for folding a sheet material is provided comprising (i) a driver for pulling a substantially continuous sheet material along a sheet path;

(ii) a first folding board positioned in the sheet path and adapted for forming a first longitudinal fold in the sheet material; (iii) a first pressurized nip positioned within the sheet path prior to the formation of a second fold and wherein the sheet material is directed through the first nip; (iv) a second folding board positioned in said sheet path and adapted for forming a second longitudinal fold in the sheet material. In an additional embodiment, the first nip is formed from a first creasing mechanism and a surface of said second folding board. In still a further embodiment, a second nip can be formed from a second creasing mechanism and a surface of said second folding board. In an additional embodiment, the first and/or second creasing mechanisms can comprise a roller and further can have a nip pressure of at least about 25 grams (g). The second nip can, in one embodiment, be positioned after the formation of the second fold wherein the sheet material is directed through the second nip. In still a further embodiment, the first and/or second creasing mechanisms can be positioned within about 1 meter of the folding operation.

In a further embodiment, a method of forming multiple longitudinal folds in a sheet material is provided and comprises (i) providing a substantially continuous sheet material; (ii) performing a first folding operation and forming a first longitudinal fold in said sheet material; (iii) drawing the folded sheet material through a first pressurized nip and wherein the first fold passes through said nip; (iv) drawing the folded sheet material over a folding board and wherein the sheet material undergoes a second folding operation thereby forming a second fold and a multi-folded sheet. In an additional embodiment, the multi-folded sheet can be drawn through a second pressurized nip. Still further, the first pressurized nip can be positioned immediately prior to and the second nip immediately after the second folding operation. In an additional embodiment, the first and/or second nips can be formed, at least in part, by a roller. Still further, the first and/or second nips can be formed, at least in part, by a surface of said folding board. In yet a further embodiment, the first and/or second nips can have a nip pressure of at least about 25 g.

In still a further embodiment, the sheet material can comprise a paper product having a basis weight between about 12 g/m$^2$ and about 60 g/m$^2$ and wherein the first and second folds are uniformly oriented in the longitudinal direction.

DESCRIPTION OF THE INVENTION

Reference will now be made in detail to embodiments of the present invention, at least one example of which is illustrated in the accompanying Figures. Each embodiment is provided by way of explanation of the invention, and not meant as a limitation of the invention. For example, features illustrated or described as part of one embodiment may be used with another embodiment to yield still further embodiments. It is intended that the present invention includes these and other modifications and variations as come within the spirit of the invention.

Numerous folding boards are known in the art for forming folds in continuous sheet materials. The specific size and shape of the board is selected based upon the ultimate fold desired as well as the size and basis weight of the sheet to be folded. By way of example only, various folding boards and folding schemes are described in the following U.S. Pat. Nos. 3,401,928; 3,679,094; 3,817,514; 3,841,620; 4,131,271; 4,502,675; 5,868,276; 6,045,002; 6,168,848; and 6,286,713. The entire contents of each of the aforesaid patents are incorporated herein by reference. The apparatus and process of the present invention are believed suitable for use in connection with a great variety of folding devices and systems. Thus, while the present invention is discussed with reference to a particular folding device and towards achieving a particular longitudinally folded sheet, it will be readily appreciated by those skilled in the art that the aspects of the present invention can be readily adapted for use in connection with other folding devices and systems. In this regard, as used herein the term "folding board" is used broadly to refer to those folding devices and systems wherein a sheet material is shaped or folded by drawing the sheet material across and/or through the device such that the shape and/or contour of the device allows the formation of a folded or shaped sheet material. Further, as used herein the terms "substantially continuous" or "continues" refer to sheet materials having an aspect ratio (length to width) greater than 100:1 such as, for example, commonly found with rolled products. In addition, while it is believed that various sheet materials can be folded using apparatus and methods of the present invention, it is described herein below with reference to a paper product.

With regard to FIGS. 1–8, folding boards are depicted for forming a series of half-folds or v-folds. The folding boards can be constructed of one or more various materials or composite materials such as, for example, metal, rigid plastic and so forth. Desirably, the folding board comprises a rigid, low-friction surface. As a particular example, stainless steel is a construction material well suited for use in the present invention. The method of forming the folding board will vary largely with the nature of the material comprising the same. With regard to metal folding boards, the desired board can be cut from a single sheet of metal and thereafter bent or otherwise manipulated into the desired shape or configuration. Alternatively, the folding board can be assembled from a collection of several parts to form the folding board of the desired dimension and shape. In addition, desirably the folding boards are buffed or otherwise treated so as to avoid the formation of sharp or irregular protrusions upon those surfaces or edges of the folding board that will contact the paper product. Further, edges and/or corners intended to contact the paper product are desirably beveled or rounded. Various methods of making folding boards are known in the art and are believed suitable for use in making the folding apparatus of the present invention.

Figure 2:
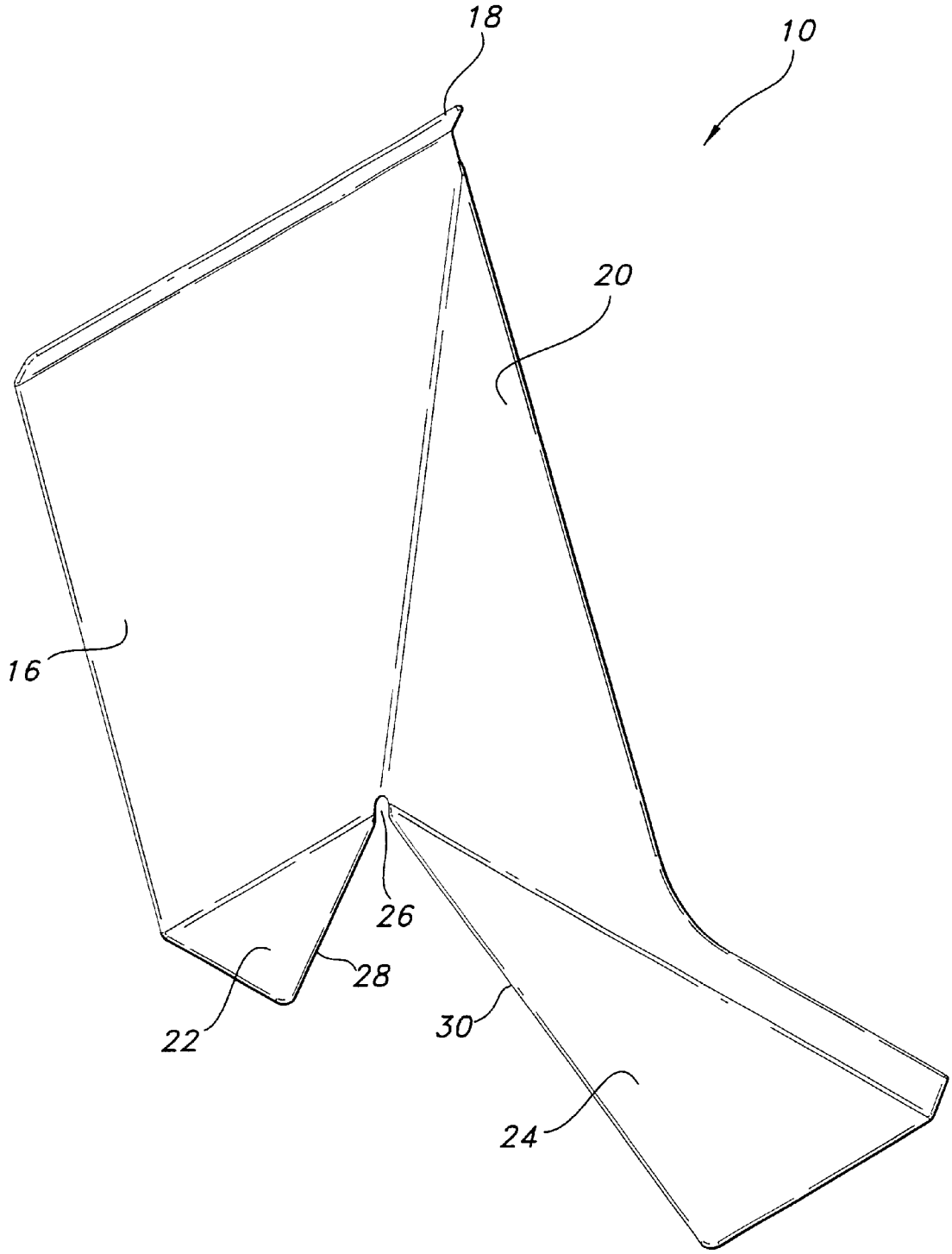
FIG. 2 is a partially elevated, angled front view of the folding board of FIG. 1.

With regard to FIGS. 1–2, a folding board 10 is depicted having a shape and configuration suitable for forming a v-fold. Folding board 10 can be held in the desired position within a converting or manufacturing line by one or more mechanisms known in the art. As an example, a mounting device can be attached to a surface that will not impede the path of the paper product and, as an example, a mounting bracket (not shown) can be attached to front side of top plate 16. The mounting bracket may itself be coupled to an arm or other supporting device (not shown) in order to maintain folding board 10 in a desired position relative to the path of the paper product. The support arm and/or mounting bracket can, optionally, be adjustable in order to vary the location and/or orientation of the folding board relative to the sheet path as desired. Top plate 16 has, extending therefrom, a first lip 18, side plate 20, first guide plate 22 and second guide plate 24. Guide opening 26 is initially formed at the juncture of top plate 16, side plate 20 and first and second guide plates 22, 24. First and second guide plates 22, 24 continue to form and define guide-opening 26 via edges 28 and 30, respectively. However, the specific size and geometry of the folding board can vary with respect to the dimension of the paper product, finished product design (e.g. fold, shape, etc.), physical characteristics of the paper product and so forth. The size, shape and orientation of the individual plates can likewise vary in numerous respects. As but one example, first guide plate 22 can have a size and/or shape similar to that of lip 18. In addition, supporting members may be added to the folding board 10 as desired to improve the rigidity and/or strength of the board as desired. As an example, a support rod or brace can be provided between two or more of the plates to prevent the board from bending as the paper product is drawn over and through the same.

As indicated above, the folding boards are suitable for longitudinally folding continuous webs and other sheet and sheet-like materials. As indicated above, the folding boards and methods are particularly well suited for folding paper products. By way of non-limiting example only, suitable paper products include those described in U.S. Pat. Nos. 3,650,882; 5,048,589; 5,399,412; 5,607,551; 5,672,248; 5,772,845; 5,776,306; 6,077,590; 6,273,996; 6,096,152 and so forth. In addition, it has been found that the apparatus and process of the present invention is also suitable for use with higher basis weight paper products. By way of example only, the apparatus and process of the present invention is suitable for use with sheet materials having a basis weight between about 10 grams per square meter ($g/m^2$) and about 100 $g/m^2$ and including towels and like materials having a basis weight between about 25 $g/m^2$ and about 60 $g/m^2$. Paper product or other materials can be unwound from a roll of product and directed in continuous sheet form to a folding area. Alternatively, the sheets can be made in-line and fed directly to the folding area. The paper product is moved across and through the series of folding boards by one or more drivers or drive mechanisms such as, for example, driven nip rolls and/or belts positioned downstream from the folding boards.

Figure 3:
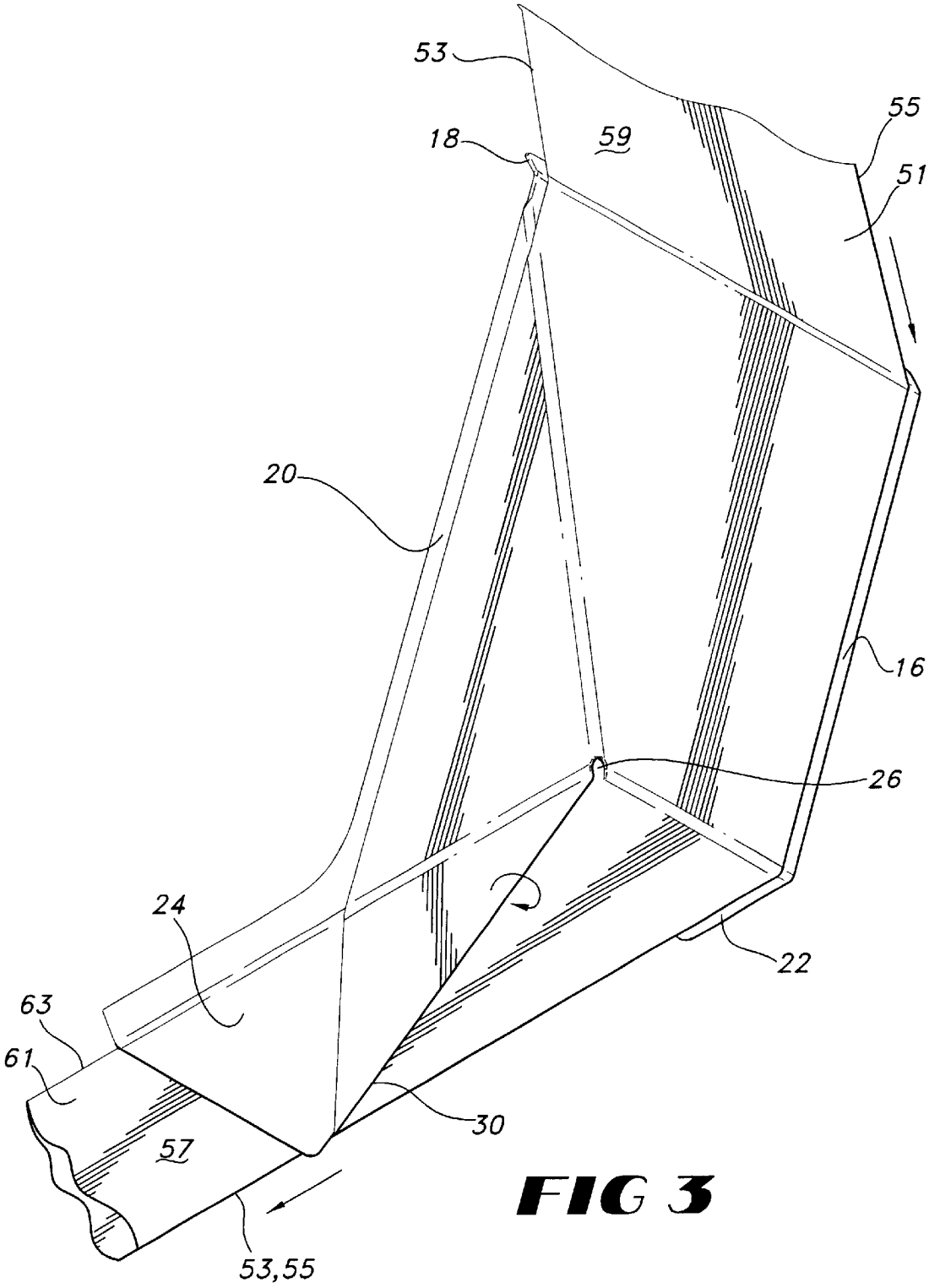
FIG. 3 is a view of paper product travelling across the folding board of FIG. 1.
Figure 4:
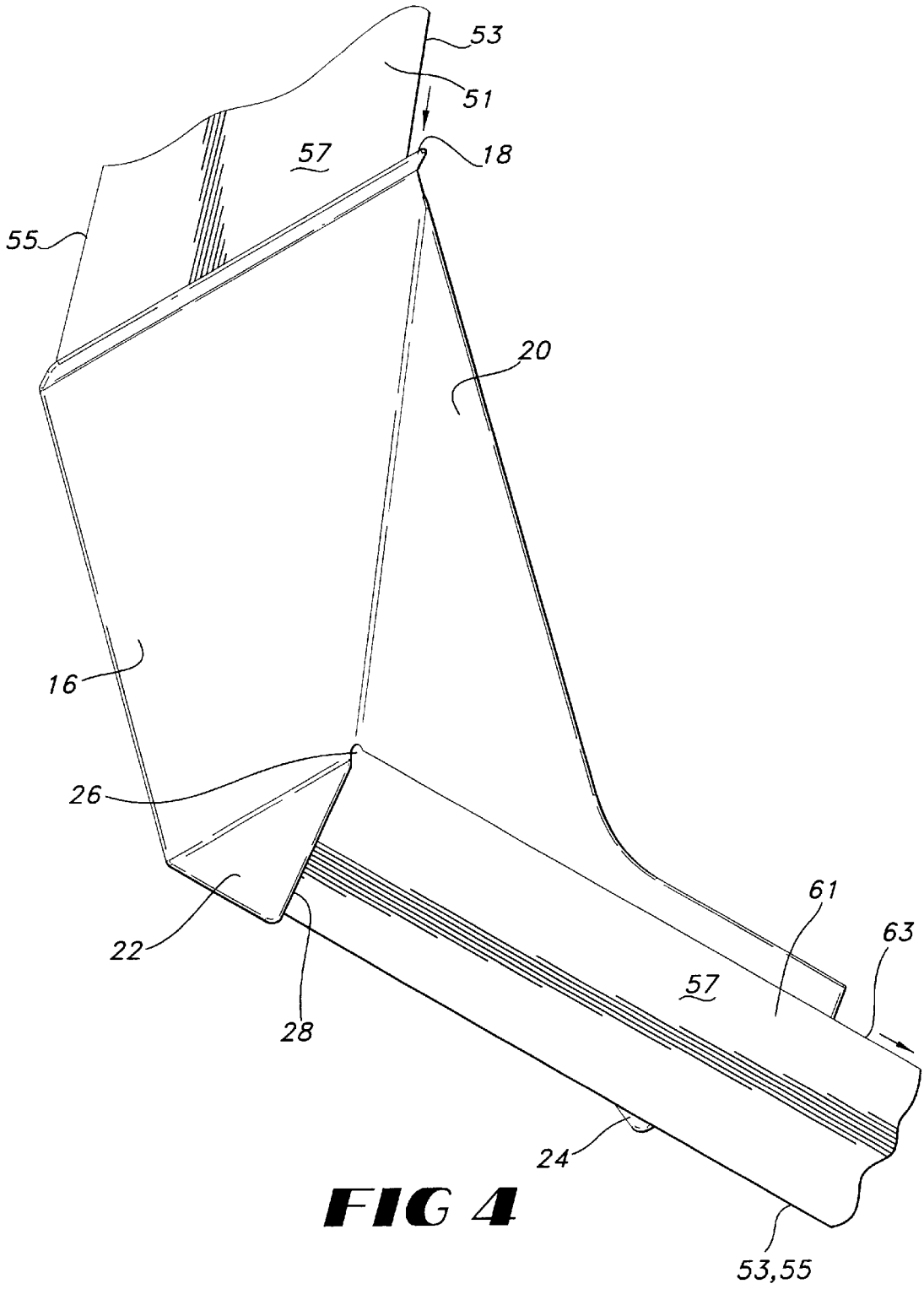
FIG. 4 is a view of paper product travelling across the folding board of FIG. 2

In reference to FIGS. 3–4, paper product 51, traveling in the direction of the arrows associated therewith, is superposed with and brought into contact with the backside of top plate 16. First lip 18 extends below the plane of top plate 16 to minimize the friction and other physical forces that may otherwise be created by initially contacting paper product 51 over a plate edge. First paper edge 53 and second paper edge 55 define the width of paper product 51. Further, paper product 51 has a first side 57 and second side 59. First side 57 of paper product 51 initially contacts the backside of top plate 16. First paper edge 53 of paper product 51 is directed onto backside of top plate 16 and then around side plate 20. A central portion of paper product 51 is fed into and through guide opening 26. By feeding a central portion of paper product 51 through guide opening 26, the left side of the fabric along with first edge 53 are caused to wrap around second guide plate 24 at edge 30 such that first side 57 of paper product 51 is folded over and onto second side 59 of paper product 51. In other words, when drawn over folding board 10, paper product 51 is folded such that second side 59 of paper product 51 folds over and onto itself thereby leaving first side 57 of paper product 51 in contact with both the upper and lower surface of second guide plate 24 and then fully exposed as it exits and travels away from folding board 10. The position of the fold line will vary with the location of the guide opening within the folding board, the position of the folding board relative to the sheet path, the width of the paper product to that of the folding board and so forth. With regard to FIGS. 3–4, paper product 51 is approximately the same width as top plate 16 at the juncture with lip 18 and guide opening 26 is centrally located and thus first fold 63 of folded paper product 61 is created at approximately the center of paper product 51. Thus, folded paper product 61 has a v-fold wherein first and second edges 53, 55 are superposed with one another. However, it will be appreciated that, in an alternate embodiment, the guide opening can be positioned off-center and thereby form a folded sheet wherein the first and second edges are offset to a desired degree.

The folding boards depicted in FIGS. 1–4, discussed herein above, produce a fold that extends to the left or, in other words, a product with the fold on the right (as it exits the folding board such as depicted in FIG. 4). This is commonly referred to as a "left-handed" board. It will be appreciated by those skilled in the art that a fold extending to the right, i.e. having the fold line located on the left as it exits the folding board, can be created utilizing a folding board that is the mirror image of those discussed and depicted with regard to FIGS. 1–4. Such a board would be a "right-handed" board. The use of left-handed and right-handed boards in series to produce inter-folded paper stacks will be discussed in more detail herein below.

Figure 5:
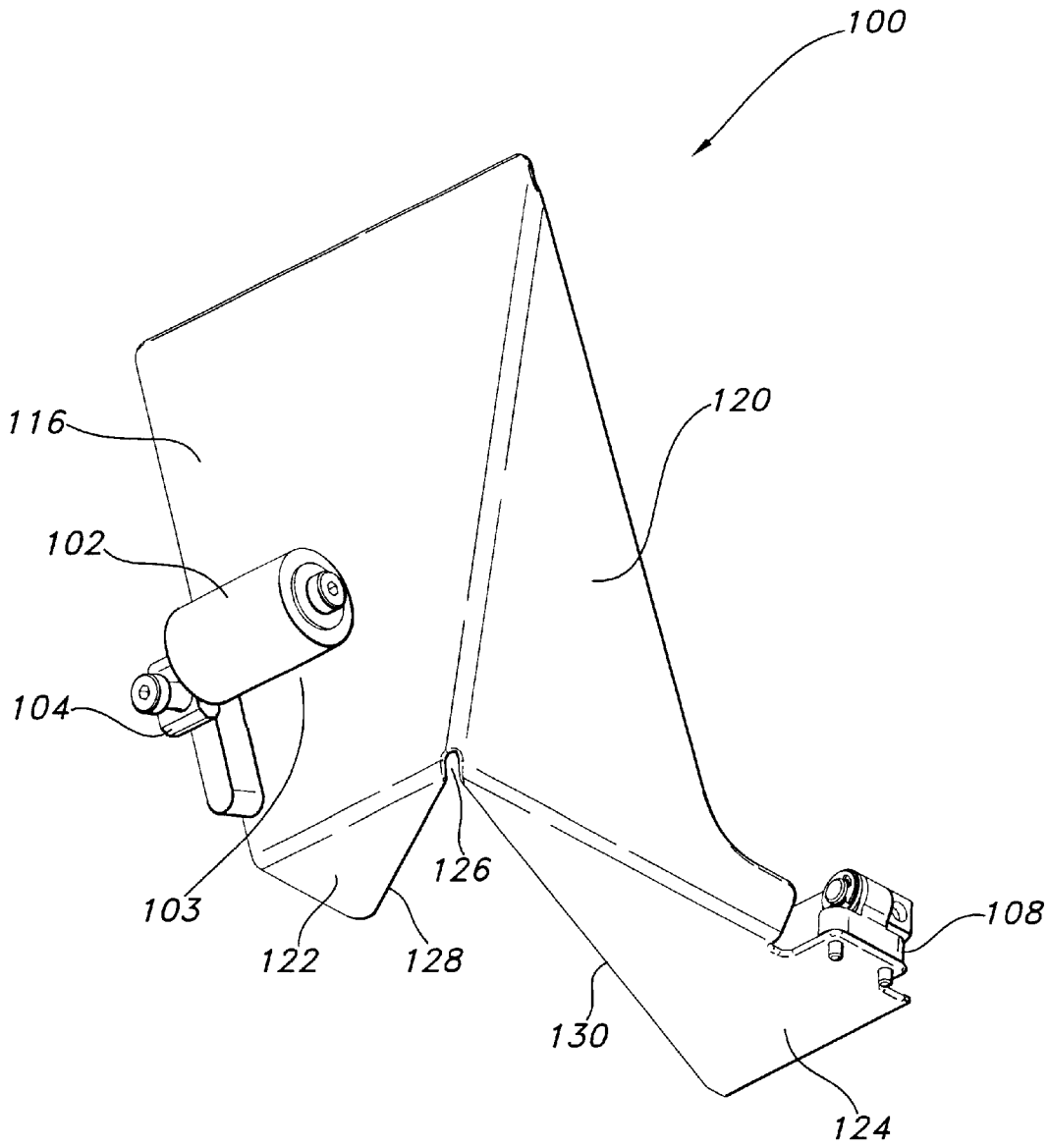
FIG. 5 is an angled, rearview of the underside of a second folding board.
Figure 6:
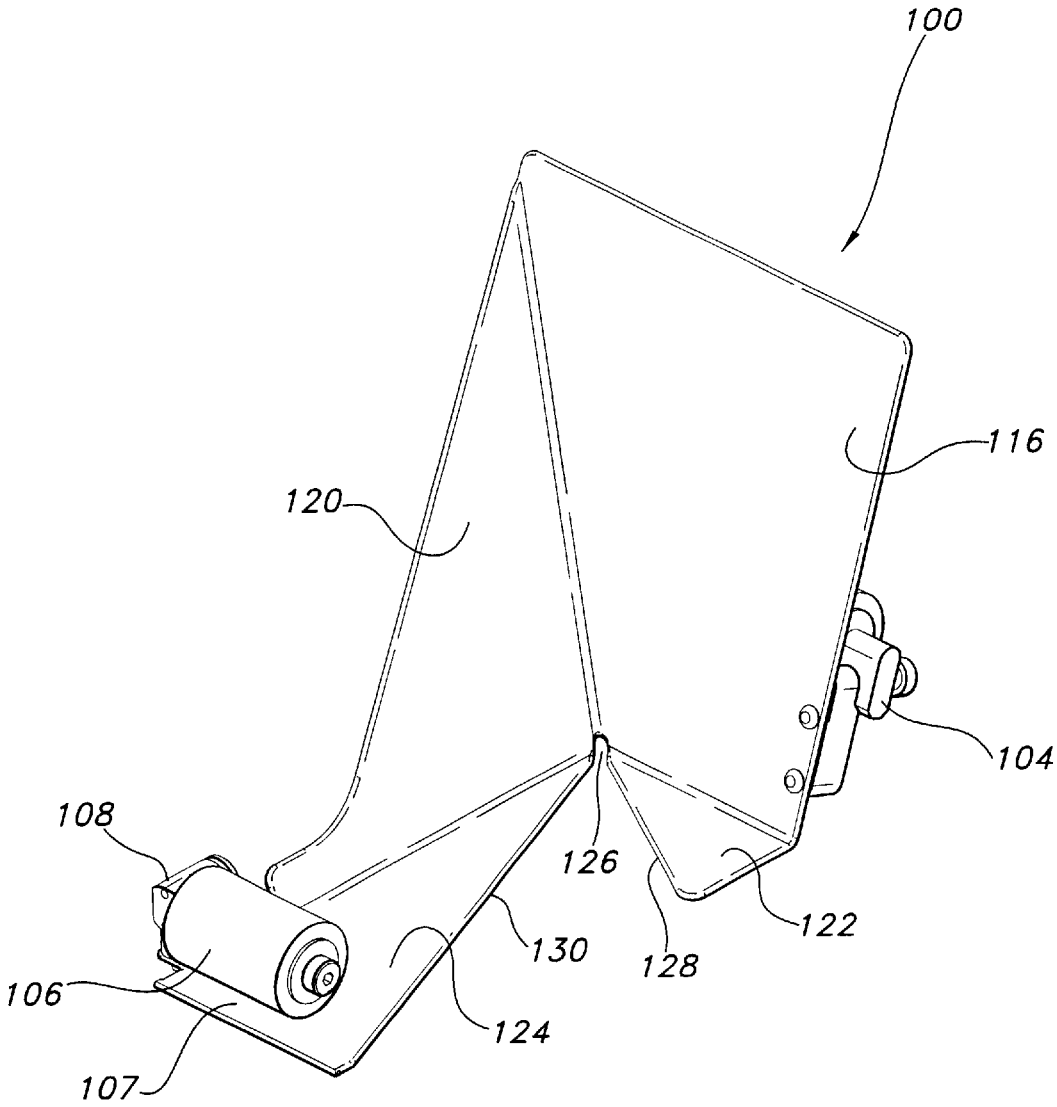
FIG. 6 is a partially elevated, angled front view of the second folding board of FIG. 5.

After exiting first folding board 10, folded paper product 61 is directed to second folding board 100. Second folding board 100 is depicted in FIGS. 5 and 6. Folding board 100 comprises top plate 116, side plate 120 and first and second guide plates 122, 124. Guide opening 126 of second folding board 100 is formed at the juncture of top plate 116, side plate 120 and first and second guide plates 122, 124. First and second guide plates 122, 124 continue to form and define guide-opening 126 via edges 128 and 130 respectively. The size and geometry of the second folding board is selected in a similar manner as that of the first folding board. However, the dimensions of the folding board will vary with respect to first folding board 10 since second folding board 100 will be acting upon a folded sheet, i.e. a sheet having increased thickness and decreased width. The second folding board can likewise be held in the desired position utilizing one or more mechanisms known in the art. As an example, the second folding board can be maintained in position using a support arm and mounting bracket. Further, as mentioned previously, the mounting bracket and/or support arm can be provided or adapted to allow for adjusting the position and/or orientation of the folding board relative to the path of the paper product as desired.

In addition, the second folding board 100 further comprises a first creasing mechanism 102. The first creasing mechanism can, optionally, be mounted to the left side of top plate 116 of second folding board 100. Desirably, first creasing mechanism 102 physically contacts the backside of top plate 116 thereby forming nip 103 having a minimum nip pressure. In addition, tensioning device 104 may be provided to allow maintenance and/or alteration of the nip pressure as desired. In addition, second folding board 100 may further include a second creasing mechanism 106. Second creasing mechanism 106 can, optionally, be mounted to second guide plate 124 of second folding board 100. Desirably, second creasing mechanism 106 physically contacts second guide plate 124 thereby forming nip 107 having a minimum nip pressure. In addition, tensioning device 108 may be provided to allow maintenance and/or alteration of the nip pressure as desired.

Figure 7:
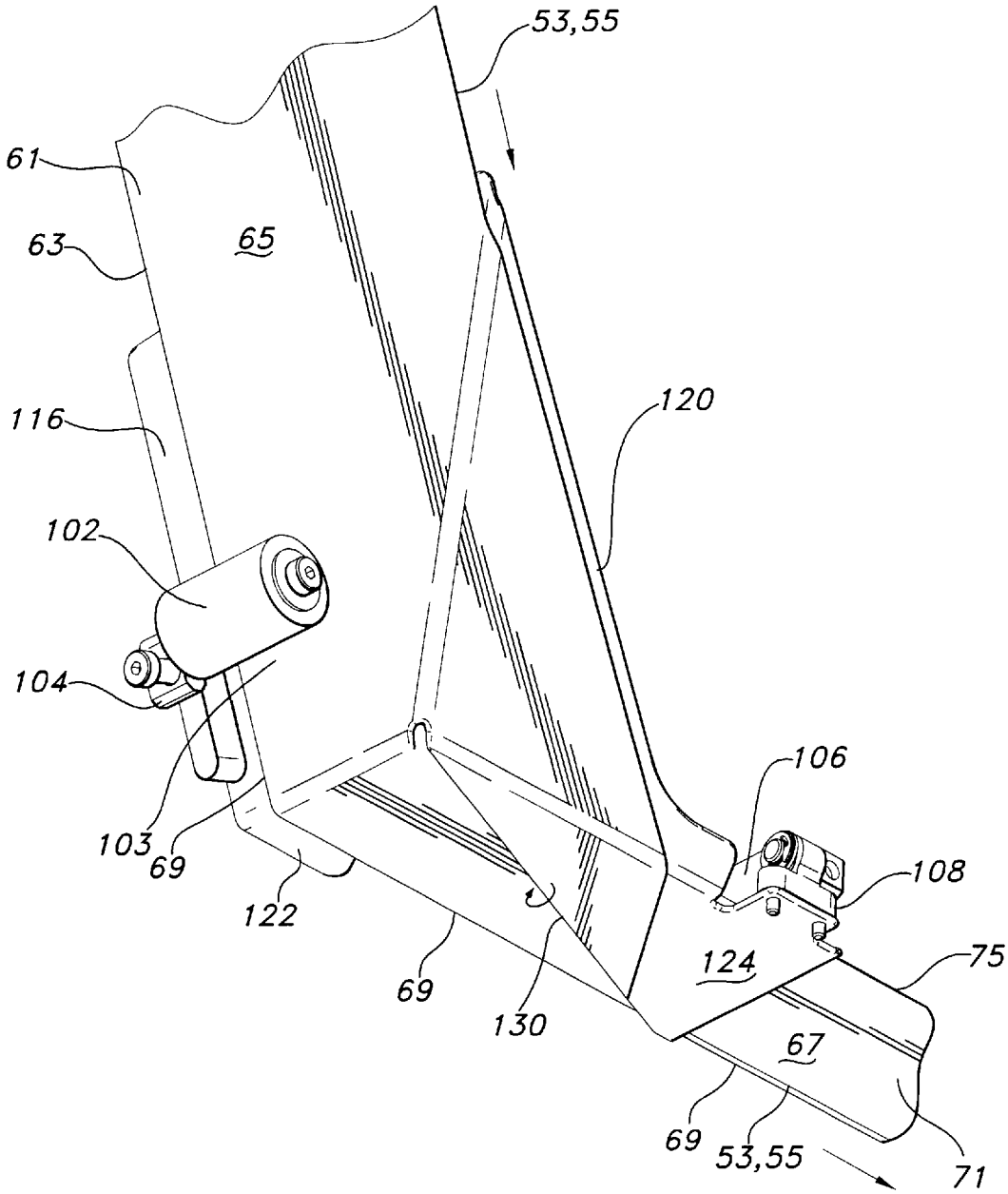
FIG. 7 is a view of paper product travelling across the folding board of FIG. 5.
Figure 8:
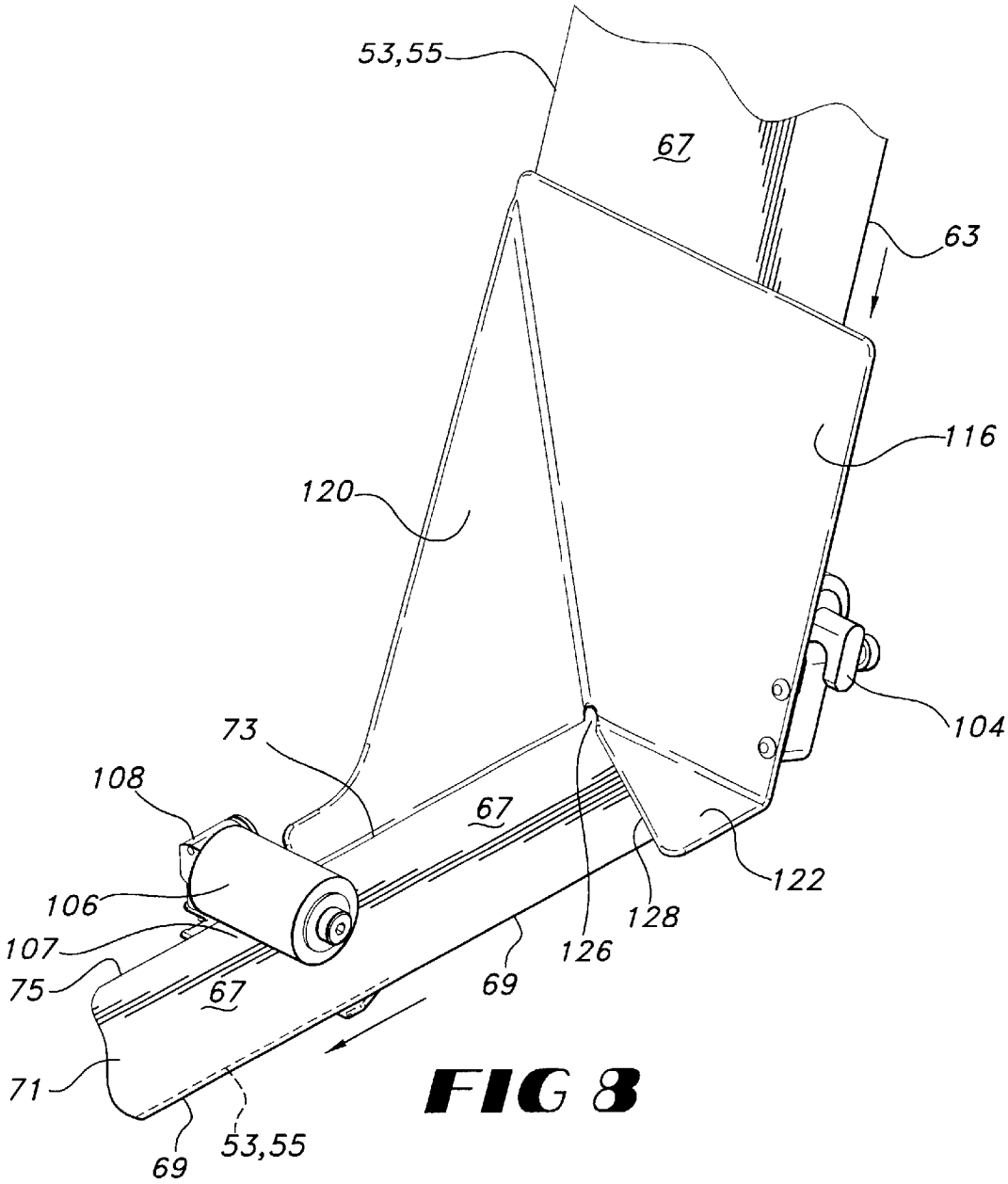
FIG. 8 is a view of paper product travelling across the folding board of FIG. 6.

In reference to FIGS. 7–8, folded paper product 61 is superposed with and brought into contact with the backside of first plate 116 of second folding board 100. Folded paper product 61, traveling in the direction of the arrows associated therewith, travels through the nip 103 formed by creasing mechanism 102 and top plate 116. First side 67 of folded paper product 61 contacts the back of top plate 116 and second side 65 of folded paper product 61 faces and contacts creasing mechanism 102. First fold 63 of folded paper product 61 travels through nip 103 thereby forming first crease 69. A central portion of folded paper product 61 enters and passes through guide opening 126 of second folding board 100. By feeding a central portion of paper product 61 through guide opening 126, the left side of the fabric along with superposed first and second edges 53, 55 are caused to travel over side plate 120, second guide plate 124 and then wrap around second guide plate 124 along edge 130 such that first and second edges 53, 55 are folded under first crease 69. In other words, when drawn over folding board 100, paper product 61 is folded such that second side 65 of paper product 61 folds over and onto itself thereby leaving first side 67 of paper product 61 in contact with the both the upper and lower surface of second guide plate 124 and then fully exposed as it exits and travels away from folding board 100. As above, the position of the fold line will vary with the location of the guide opening within the folding board and the width of the paper product to that of the folding board. With regard to FIGS. 7–8, paper product 61 is approximately the same width as top plate 116 and guide opening 26 is located slightly off-center. Thus, while still forming a v-fold, second fold 73 of multi-folded paper product 71 is positioned slightly off-center and first and second edges 53, 55 are slightly offset from first crease 69. Second fold 73 of multi-folded paper product 71 is formed adjacent the intersection of side plate 120 and second guide plate 124. Thus, second fold 73 travels through nip 107, formed by second creasing mechanism 106 and second guiding plate 124 of second folding plate 100, thereby forming second crease 75 of multi-folded paper product 71.

The folding boards depicted in FIGS. 5–8, discussed herein above, produce a fold that extends to the right or, in other words, a product with the crease on the left (as it exits the folding board such as shown in reference to FIG. 8). This is commonly referred to as a "right-handed" board. It will be appreciated by those skilled in the art that a fold extending to the left, i.e. with the crease on the right as it exits the folding board, can be created utilizing a folding board that is the mirror image of those discussed and depicted with regard to FIGS. 5–8. Such a board would be a "left-handed" board. The use of left-handed and right-handed boards in series to produce inter-folded paper stacks will be discussed in more detail herein below.

With regard to the creasing mechanisms and/or fold stabilizers, the nip pressure created between the creaser and plate will vary with respect to various factors including, but not limited to, the physical properties of the paper product (e.g. basis weight, thickness, etc.), line speed and drawing tension, and so forth. Desirably, the nip pressure is at least about 25 g and still more desirably is between about 25 g and about 1000 g and even still more desirably is between about 100 g and about 400 g. The creasing mechanism can extend across only a section of the folded paper product or can extend across the entire width of the folded paper product. Desirably, the creaser extends across from 10% to 100% of the paper product and still more desirably extends across from 25% to about 90% of the folded paper product. Still further, the creaser desirably extends across at least about 50% of the width of the folded paper product. The creasing mechanism can comprise an element suitable for forming a nip and, by way of non-limiting example only, can comprise a stationary plate, rod, bar, coil and so forth. Desirably the creasing mechanism comprises a roller. Suitable materials for forming the creasing mechanism include, but are not limited to, steel, plastic, rubber and so forth.

As indicated above, the nip created in part by the creasing mechanism desirably has a minimum pressure. This pressure may desirably be altered from time to time when varying other process parameters and/or the paper product itself. Thus, the creasing mechanism can, optionally, be provided to be adjustable. In reference to FIGS. 5–6, creasing mechanisms 102 and 106 can be caused to contact the respective plates 116, 124 using a spring loaded mounting mechanism 104 and 108. In addition, the creasing mechanism can be pivotally mounted to the folding board utilizing a torsioned spring. The ability to pivot the roller allows the operators to more easily feed the paper product into the system as well as adjust the nip pressure as desired. The mounting mechanism need not itself be attached to the folding board and can, in an alternate embodiment, be mounted to another surface. Further, the mounting mechanism may utilize other mechanisms to create the nip pressure including, but not limited to, magnetic forces, pneumatic pressure, hydraulic pressure, and so forth.

While not wishing to be limited to a particular theory, it is believed that the creasing mechanism acts to form a more substantial or permanent fold, that is a fold having increased integrity. In addition, the majority of the twisting and torsion forces experienced by the paper product occur proximate the guide hole and/or guide plates. Thus, it is further believed that the creasing mechanisms prevent the rotating or twisting forces from being transferred up the sheet and act to hold or set the pre-established fold in its desired location. Thus, the first and/or second creasing mechanisms are positioned proximate to the folding operation and desirably are positioned within about 1 meter (m) of the region where the paper product experiences significant twisting and bending forces. With reference to FIGS. 7–8, the folding operation and the significant twisting forces associated therewith, initiate proximate the guide opening. Desirably one or more nips are positioned within about 0.5 m and still more desirable within about 0.25 m of the folding operation. As used herein the distance from the folding operation or high stress region is measured along the path of the paper product. Thus, the sheet material and/or fold pass through the nip immediately prior to undergoing the folding operation. Preferably, the fold passes through the nip immediately prior to or contemporaneous with the onset of significant twisting or other physical forces associated with the folding operation. In reference to FIGS. 5 and 6, the creasing mechanism forms a nip using one of the plates in the folding board itself. However, the creasing mechanism need not form a nip with the folding board itself and can be positioned to form a nip with yet another surface.

Figure 6A:
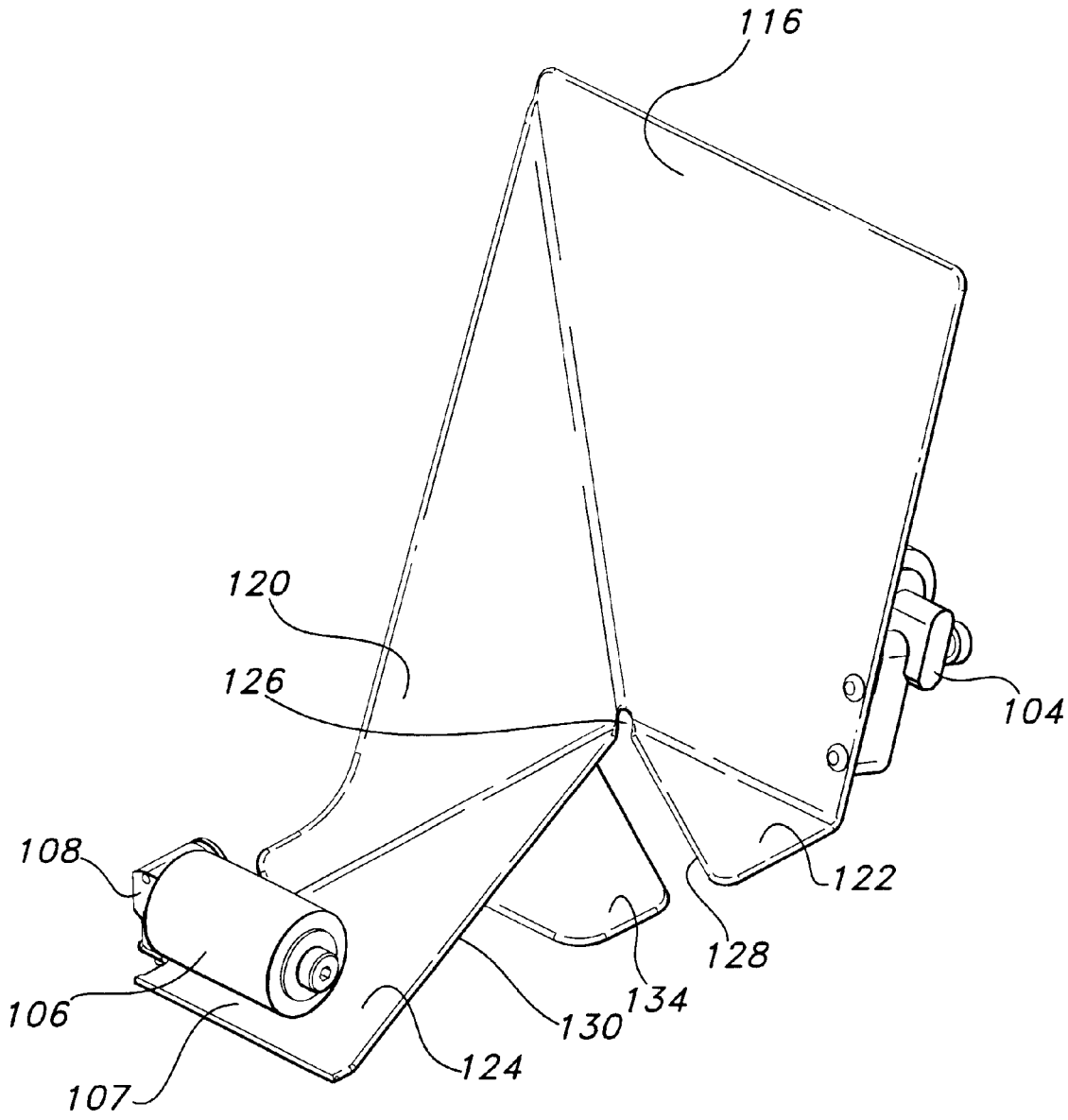
FIG. 6A is a partially elevated, angled front view of the second folding board of FIG. 5 and including a dividing plate.
Figure 9:
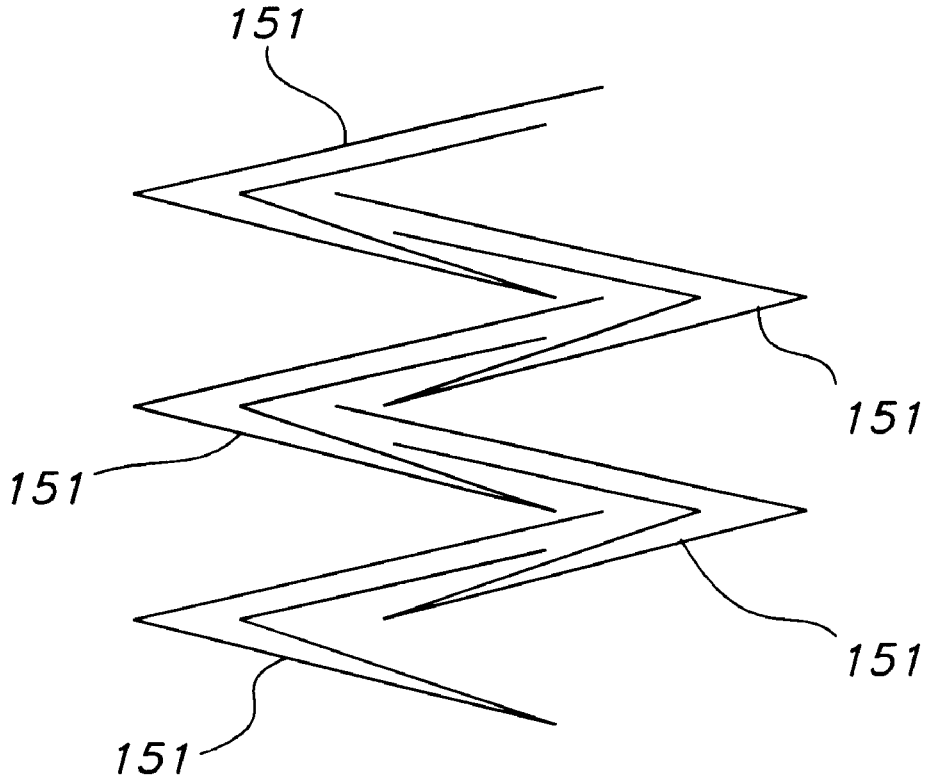
FIG. 9 is a cross-sectional, exploded view of a stack of inter-leafed paper products.

The folding boards may be used to form a stack of inter-folded paper products. As an example, and in reference to FIG. 6A, a dividing plate 134 may be provided for opening a previously folded paper product. Dividing plate 134 causes the prior folded sheet (not shown) to open and thus a portion of the sheet undergoing a folding operation is directed into the opened sheet. However, it will be appreciated that the folded sheets will have opposite folds, that is one will extend to the left and the other to the right. This can readily be achieved wherein the first sheet is formed using a right-handed first board and a left-handed second board and the second sheet is formed using a left-handed first board and a right-handed second board, the latter being the series depicted in FIGS. 1–8. A longitudinally folded stack of paper product formed by the folding boards shown and described in reference to FIGS. 1–8 is depicted in FIG. 9. Individual sheets 151 are inter-leafed having fold lines and edges oppositely arranged and positioned. After forming a stack of desired height and/or having the desired number of folded sheets, the product can then be cut to form the desired sheet length.

While the present invention has been particularly described with respect to the use of a paper product, the present invention is suitable for use with a wide range of webs and/or other sheet materials. By way of example only, additional sheet and sheet-like materials believed suitable for use with the present invention are described in the following U.S. Pat. Nos. 4,001,472; 4,100,324; 4,775,582; 4,833,003; 5,048,589; 5,284,703; 5,350,624.

While various patents and other reference materials have been incorporated herein by reference, to the extent there is any inconsistency between incorporated material and that of the written specification, the written specification shall control. In addition, while the invention has been described in detail with respect to specific embodiments and/or examples thereof, it will be apparent to those skilled in the art that various alterations, modifications and other changes may be made to the invention without departing from the spirit and scope of the present invention. It is therefore intended that the claims cover or encompass all such modifications, alterations and/or changes.

What is claimed is:

1. A device for folding a sheet material comprising:

a folding device having a plurality of surfaces and adapted to longitudinally fold a sheet material drawn across said folding device, said folding device comprising a top plate having a first surface and a first creasing mechanism coupled thereto, the top plate and first surface extending in a first plane, the first creasing mechanism configured to form a pressurized nip with the first surface;

a second guide plate having a second surface and a second creasing mechanism coupled thereto, the second guide plate and second surface extending in a second plane, the second creasing mechanism configured to form a pressurized nip with the second surface, the second guide slate and second surface positioned so that the second plane is not parallel with the first plane;

a side plate having a third surface, the side plate and the third surface extending in a third plane, the side plate configured to join the top plate and the second guide plate together, a guide opening provided at a juncture of the top plate, the second guide plate, and the side plate, wherein when sheet material is drawn across the first surface of the top slate in the first plane and the side surface of the side plate in the third plane, a portion of sheet material extends into the guide opening and the sheet material emerges onto the second surface of the second guide plate in the second plane opposite the first and third surfaces in a folded configuration.

2. The folding device of claim 1 wherein the first creasing mechanism comprises a roller.

3. The folding device of claim 1 wherein the second creasing mechanism comprises a roller.

4. The folding device of claim 2 further comprising a means for altering the nip of the first and second creasing mechanisms.

5. The folding device of claim 1 wherein the first and second creasing mechanisms are positioned within 1 meter of the guide opening.

6. The folding device of claim 5 wherein the first and second creasing mechanism comprise rollers configured to providing a nip pressure of at least about 25 g.

7. The folding device of claim 1 wherein the first surface of the top plate and the second surface of the second guide plate are contiguous with the third surface of the side plate.

8. The folding device of claim 1 wherein the first surface has an upper side and a lower side and further wherein the first creasing mechanism forms a pressurized nip with the lower side of the said first surface.

9. The folding device of claim 1 wherein the second surface has an upper side and a lower side and further wherein the second creasing mechanism forms a pressurized nip with the upper side of the second surface.

10. The folding device of claim 8 wherein the first creasing mechanism comprises a roller.

11. The folding device of claim 9 wherein the second creasing mechanism comprises a roller.

* * * * *